US007998047B2

(12) United States Patent
Spivey, Sr. et al.

(10) Patent No.: US 7,998,047 B2
(45) Date of Patent: Aug. 16, 2011

(54) CARTON WITH REINFORCED HANDLE

(75) Inventors: Raymond Rudolph Spivey, Sr., Mableton, GA (US); Jean-Manuel Gomes, Marietta, GA (US); Leonard M. Cooper, Powder Springs, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 1273 days.

(21) Appl. No.: 11/532,293

(22) Filed: Sep. 15, 2006

(65) Prior Publication Data

US 2007/0063003 A1 Mar. 22, 2007

Related U.S. Application Data

(60) Provisional application No. 60/719,040, filed on Sep. 21, 2005.

(51) Int. Cl.
*B65D 5/46* (2006.01)
*B65D 17/00* (2006.01)

(52) U.S. Cl. ..... 493/88; 229/117.16; 229/242

(58) Field of Classification Search ..... 229/117.16, 229/117.08, 117.09, 117.12, 117.15, 117.17; 493/70, 80, 88

See application file for complete search history.

(56) References Cited

U.S. PATENT DOCUMENTS

| | | | | |
|---|---|---|---|---|
| 2,196,502 | A * | 4/1940 | Kells | 229/117.17 |
| 2,308,050 | A | 1/1943 | Burr | |
| 2,386,905 | A | 10/1945 | Meitzen | |
| 2,648,484 | A | 8/1953 | Belsinger | |
| 2,900,123 | A | 8/1959 | Drnec et al. | |
| 3,173,596 | A | 3/1965 | Aust et al. | |
| 3,756,499 | A * | 9/1973 | Giebel et al. | 229/117.17 |
| 4,005,815 | A | 2/1977 | Nerenberg et al. | |
| 4,538,759 | A | 9/1985 | Dutcher | |
| 4,621,766 | A | 11/1986 | McClure | |
| 5,072,876 | A | 12/1991 | Wilson | |
| 5,119,985 | A | 6/1992 | Dawson et al. | |
| 5,350,109 | A | 9/1994 | Brown et al. | |
| 5,588,585 | A | 12/1996 | McClure | |
| 6,112,977 | A | 9/2000 | Sutherland et al. | |
| 6,170,741 | B1 | 1/2001 | Skolik et al. | |
| 6,250,542 | B1 | 6/2001 | Negelen | |
| 6,595,411 | B2 * | 7/2003 | McClure | 229/143 |

(Continued)

FOREIGN PATENT DOCUMENTS

EP 0870688 A1 10/1998

(Continued)

*Primary Examiner* — Justin M Larson
*Assistant Examiner* — Christopher DeMeree
(74) *Attorney, Agent, or Firm* — Womble Carlyle Sandridge & Rice, PLLC

(57) ABSTRACT

A carton for containing a plurality of articles. The carton has panels that extend at least partially around an interior of the carton. The panels comprise a top panel, a bottom panel, a first side panel, and a second side panel. At least two end flaps are respectively foldably attached to respective panels of the plurality of panels, wherein the end flaps are overlapped with respect to one another and thereby at least partially form a closed end of the carton. The carton includes a handle in the closed end of the carton for grasping and carrying the carton. At least one end flap of the at least two end flaps comprises a main panel for closing the closed end of the carton and an extension panel foldably attached to the main panel. The extension panel is positioned above the handle to reinforce the carton.

24 Claims, 4 Drawing Sheets

U.S. PATENT DOCUMENTS

| | | | | |
|---|---|---|---|---|
| 6,631,803 | B2 | 10/2003 | Rhodes et al. | |
| 6,766,940 | B2 | 7/2004 | Negelen | |
| 6,848,573 | B2 | 2/2005 | Gould et al. | |
| 6,968,992 | B2 | 11/2005 | Schuster | |
| 7,757,933 | B2 | 7/2010 | Dunn | |
| 7,775,418 | B2 | 8/2010 | Walling | |
| 7,780,067 | B2 | 8/2010 | Holley, Jr. | |
| 7,832,622 | B2 | 11/2010 | Spivey, Sr. | |
| 2005/0087592 | A1 | 4/2005 | Schuster | |
| 2005/0189405 | A1 * | 9/2005 | Gomes et al. | 229/122 |
| 2005/0263574 | A1 | 12/2005 | Schuster | |
| 2006/0081691 | A1 | 4/2006 | Smalley | |
| 2006/0278689 | A1 * | 12/2006 | Boshinski et al. | 229/117.16 |
| 2007/0063003 | A1 | 3/2007 | Spivey et al. | |
| 2007/0108261 | A1 | 5/2007 | Schuster | |
| 2007/0131748 | A1 | 6/2007 | Brand | |
| 2010/0025457 | A1 | 2/2010 | Cooper et al. | |

FOREIGN PATENT DOCUMENTS

| | | |
|---|---|---|
| WO | WO 99/28198 | 6/1999 |

* cited by examiner

CARTON WITH REINFORCED HANDLE

CROSS-REFERENCE TO RELATED APPLICATIONS

This application claims the benefit of U.S. Provisional Application No. 60/719,040, filed on Sep. 21, 2005, the entire contents of which are hereby incorporated by reference as if presented herein in their entirety.

BACKGROUND OF THE INVENTION

The present invention generally relates to cartons for holding and dispensing beverage containers or other types of articles. More specifically, the present invention relates to cartons having a reinforced handle.

Cartons, such as paperboard cartons used to hold, carry or dispense articles are well known. These cartons usually are formed or assembled by folding a paperboard carton blank that has been cut, perforated and creased in selected areas to achieve desired features and characteristics. These features include tear lines, handles, opening features, dispensers and other well-known attributes. Such handle features can be formed, for example, in the top panel or alternatively in an end or ends of the carton. These handles can define a hole or other opening to permit the handle to be grasped by the user so that the loaded carton can be conveniently carried via the handle.

When fabricating a carrier or carton from the paperboard carton blank, opposite ends of the blank typically are attached to each other by glue or by mechanical locks to form the bottom panel of the carrier. End flaps are included on sides of some or all panels and are folded inwardly to close the ends of the carton and enclose articles, such as beverage containers, therewithin. These end flaps can contain opening or dispensing features or can include handles for carrying the carton. These handles often create problems when, for example, the handle opening weakens and/or tears the paperboard or other material of the carton.

SUMMARY OF THE INVENTION

In general, one aspect of the invention is directed to a carton for containing a plurality of articles. The carton comprises a plurality of panels that extend at least partially around an interior of the carton. The plurality of panels comprise a top panel, a bottom panel, a first side panel, and a second side panel. At least two end flaps are respectively foldably attached to respective panels of the plurality of panels, wherein the end flaps are overlapped with respect to one another and thereby at least partially form a closed end of the carton. The carton includes a handle in the closed end of the carton for grasping and carrying the carton. At least one end flap of the at least two end flaps comprises a main panel for closing the closed end of the carton and an extension panel foldably attached to the main panel. The extension panel is positioned above the handle to reinforce the carton.

In another aspect, the invention is generally directed to a blank for forming a carton comprising a plurality of panels comprising a top panel, a bottom panel, a first side panel, and a second side panel. At least two end flaps are respectively foldably attached to respective panels of the plurality of panels. Features in the at least two end flaps are for cooperating to at least partially define a handle in a carton erected from the blank. At least one end flap of the at least two end flaps comprises a main panel for closing an end of the carton erected from the blank and an extension panel foldably attached to the main panel. The extension panel is for being positioned above the handle when the blank is erected into the carton.

In yet another aspect, the invention is generally directed to a method of assembling a carton. The method comprises providing a carton having a plurality of panels comprising a top panel, a bottom panel, a first side panel, and a second side panel. The carton has at least one side end flap foldably attached to at least one of the side end panels at a first end of the carton, at least one top end flap foldably attached to the top panel at the first end, and a handle. The handle is formed at least in part in the top end flap and the at least one side end flap. The at least one side end flap comprising a main panel for at least partially forming a closed end of the carton and an extension panel foldably attached to the main panel above the handle of the carton. The at least one side end flap is folded to at least partially close the first end of the carton. The top end flap is folded downward to contact the extension panel and to fold the extension panel downward to overlap the main panel of the side end flap during the at least partially closing of the first end. The top panel is secured in the downwardly folded position to at least partially form the closed first end of the carton.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the invention.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present invention generally relates to cartons that contain articles such as containers, bottles, cans, etc. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present invention can accommodate articles of any shape. For the purpose of illustration and not for the purpose of limiting the scope of the invention, the following detailed description describes beverage containers (e.g., plastic beverage bottles) as disposed within the carton embodiments. In this specification, the terms "lower," "bottom," "upper" and "top" indicate orientations determined in relation to fully erected and upright cartons.

Figure 1:
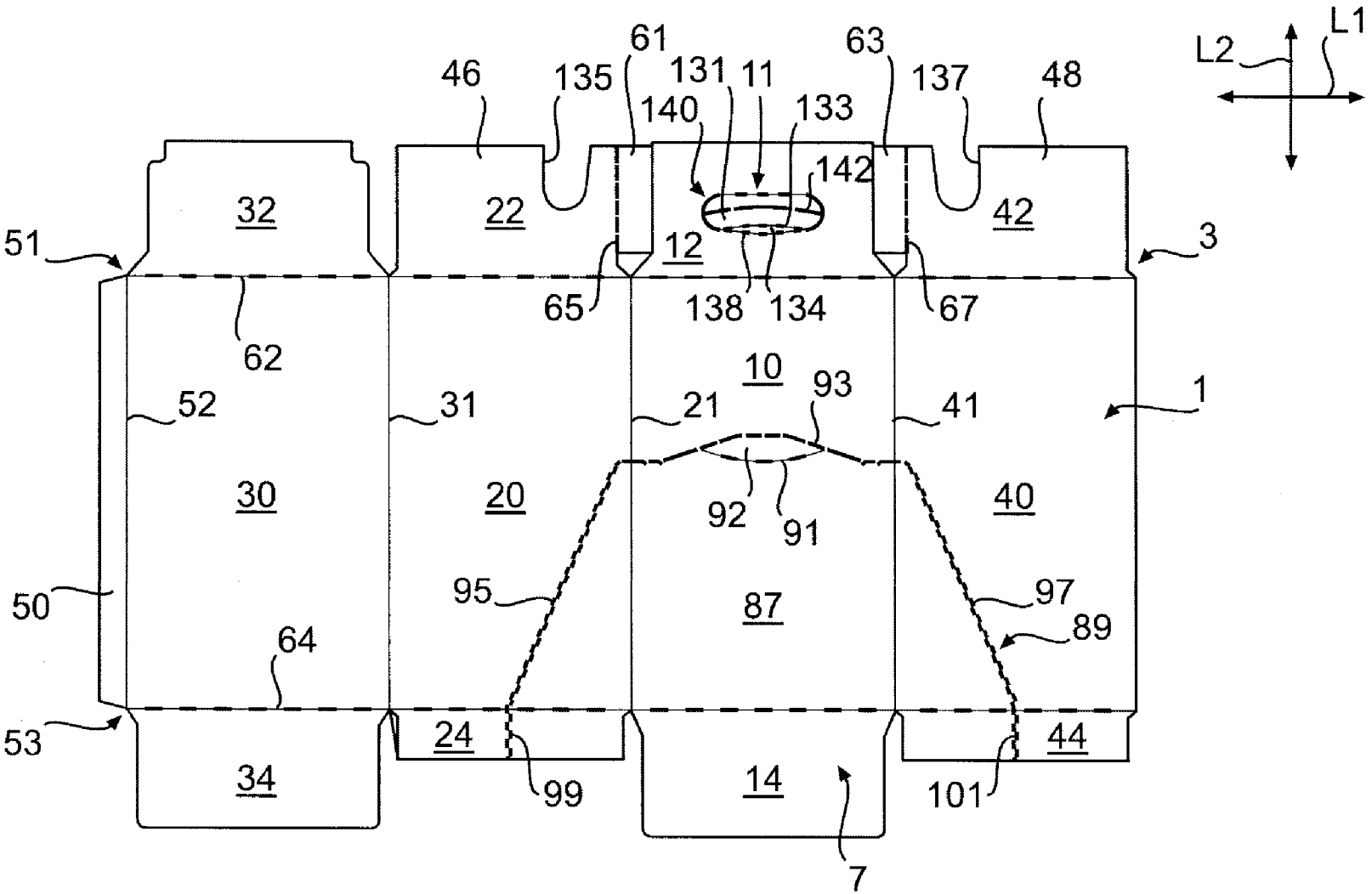
FIG. 1 is a plan view of a blank used to form a carton according to a first embodiment of the invention.
Figure 2:
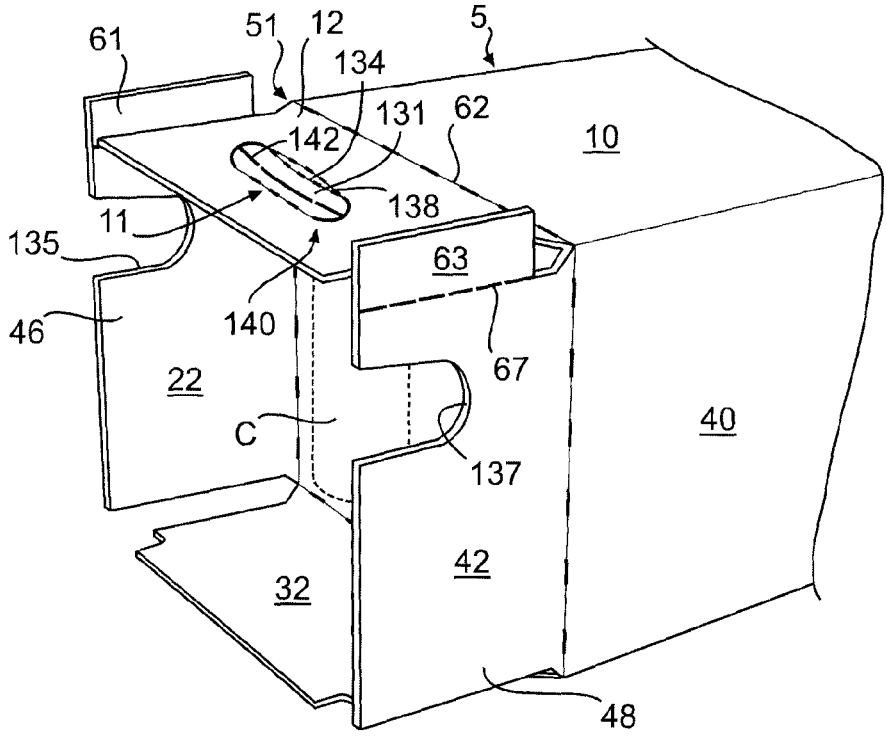
FIG. 2 is a partial perspective of the carton in a partially assembled condition showing a first end of the carton.
Figure 3:
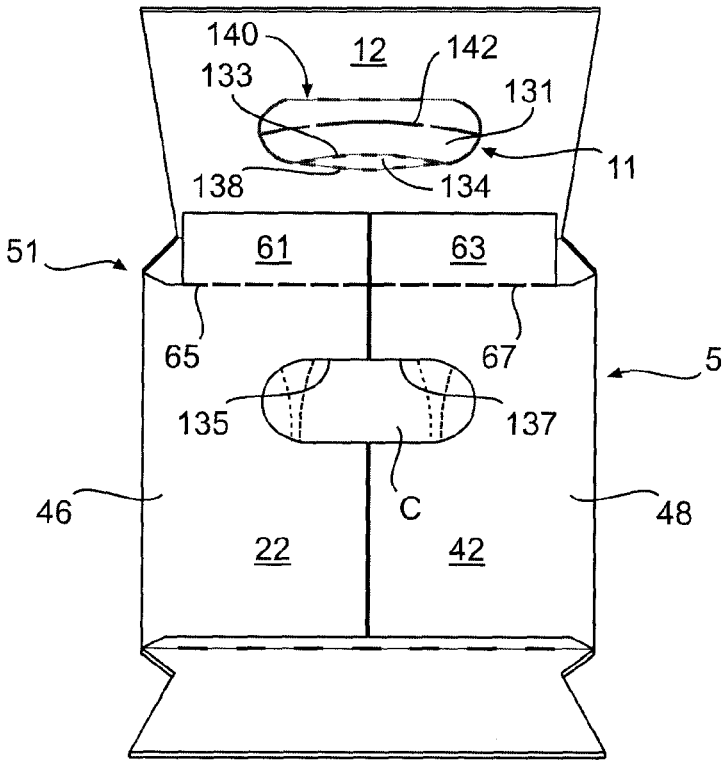
FIG. 3 is an end view of the first end of the carton partially closed.
Figure 4:
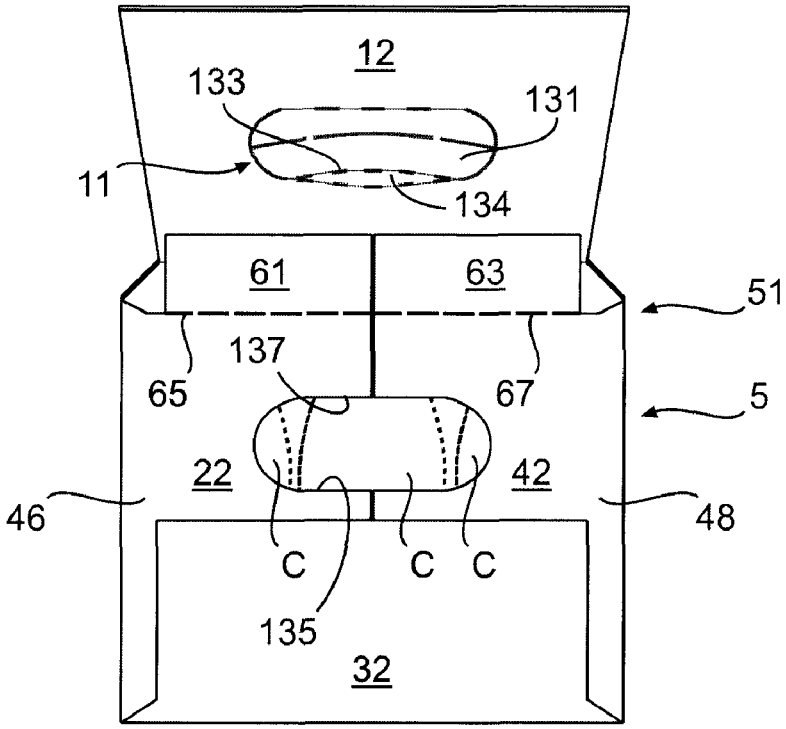
FIG. 4 is a view similar to FIG. 3 but showing the first end of the carton further closed.

FIG. 1 is a plan view of the exterior side 1 of a blank, generally indicated at 3, used to form a carton 5 (FIGS. 2-6) according to the exemplary embodiment of the invention. The carton 5 can be used to house a plurality of articles such as containers C (FIG. 2). The carton 5 has a dispenser, generally indicated at 7 (FIG. 3), formed in the carton for allowing access to the containers C. In the illustrated embodiment, the carton 5 is sized to house fifteen containers C in a single layer in a 3×5 arrangement, but it is understood that the carton 5 may be sized and shaped to hold containers of a different or same quantity in more than one layer and/or in different row/column arrangements (e.g., 1×6, 3×6, 2×6×2, 3×4×2, 2×9, 2×6, 3×4, etc.). In the illustrated embodiment, the carton 5 includes a handle, generally indicated at 11 for grasping and carrying the carton. As will be discussed below in more detail, the handle 11 is formed from various features in the blank 3.

The blank 3 has a longitudinal axis L1 and a lateral axis L2. In the illustrated embodiment, the blank 3 comprises a top panel 10 foldably connected to a first side panel 20 at a first lateral fold line 21, a bottom panel 30 foldably connected to the first side panel 20 at a second lateral fold line 31, and a second side panel 40 foldably connected to the top panel 10 at a third lateral fold line 41. In the illustrated embodiment, the blank 3 includes an adhesive flap 50 foldably connected to the bottom panel 30 at a fourth lateral fold line 52.

The top panel 10 is foldably connected to a first top end flap 12 and a second top end flap 14. The first side panel 20 is foldably connected to a first side flap 22 and a second side flap 24. The bottom panel 30 is foldably connected to a first bottom end flap 32 and a second bottom end flap 34. The second side panel 40 is foldably connected to a first side flap 42 and a second side flap 44. In the illustrated embodiment, the first side end flaps 22, 42 each comprise a main panel 46, 48 and an extension panel 61, 63 foldably connected to the main panel along a respective lateral fold line 65, 67. When the carton 5 is erected, the top and bottom end flaps 12 and 32 and side end flaps 22 and 42 close a first end 51 of the carton, and the top and bottom end flaps 14 and 34 and side end flaps 24 and 44 close a second end 53 of the carton. In accordance with an alternative embodiment of the present invention, different flap arrangements can be used for closing the ends 51, 53 of the carton 5.

The top and bottom end flaps 12 and 32 and side end flaps 22 and 42 extend along a first marginal area of the blank 3, and are foldably connected at a first longitudinal fold line 62 that extends along the length of the blank. The top and bottom end flaps 14 and 34 and side end flaps 24 and 44 extend along a second marginal area of the blank 3, and are foldably connected at a second longitudinal fold line 64 that also extends along the length of the blank. The longitudinal fold lines 62, 64 may be, for example, substantially straight, or offset at one or more locations to account for blank thickness or for other factors.

The dispenser 7 includes a dispenser panel 87 formed in the top panel 30, side panels 20, 40, side flaps 24, 44, and top end flap 14. The dispenser panel 87 is separable from the carton 5 along a tear line, generally indicated at 89, to form an opening (not shown) in the carton. The dispenser 7 includes a finger panel 92 in the top panel 10 that is foldable along a curved fold line 91 for grasping of the dispenser panel 87. The tear line 89 includes a first portion 93 in the top panel 10 that extends between the lateral fold lines 21, 41 and connects respective ends of the curved fold line 91 to define the finger panel 92. The tear line 89 has a second portion 95 in the first side panel 20 that extends generally obliquely from the lateral fold line 21 to the longitudinal fold line 64. The tear line 89 has a third portion 97 in the second side panel 40 extending generally obliquely from the lateral fold line 41 to the longitudinal fold line 64. The tear line 89 has a fourth portion 99 extending laterally from the intersection of the second portion 95 with the longitudinal fold line 64 through the side end panel 24. The tear line 89 has a fifth portion 101 extending laterally from the intersection of the third portion 97 with the longitudinal fold line 64 through the side end panel 44. The dispenser 7 can be opened by grasping the finger panel 92 and tearing the dispenser panel 87 along the tear line 89 to at least partially remove the dispenser panel and expose the top portion of the containers C in the carton 5 to allow removal of the containers from the carton. The dispenser 7 may be otherwise sized, shaped, and/or located in the carton 5 without departing from the scope of this invention. Further, the dispenser 7 may be omitted from the carton 5 without departing from the scope of the invention.

Figure 7:
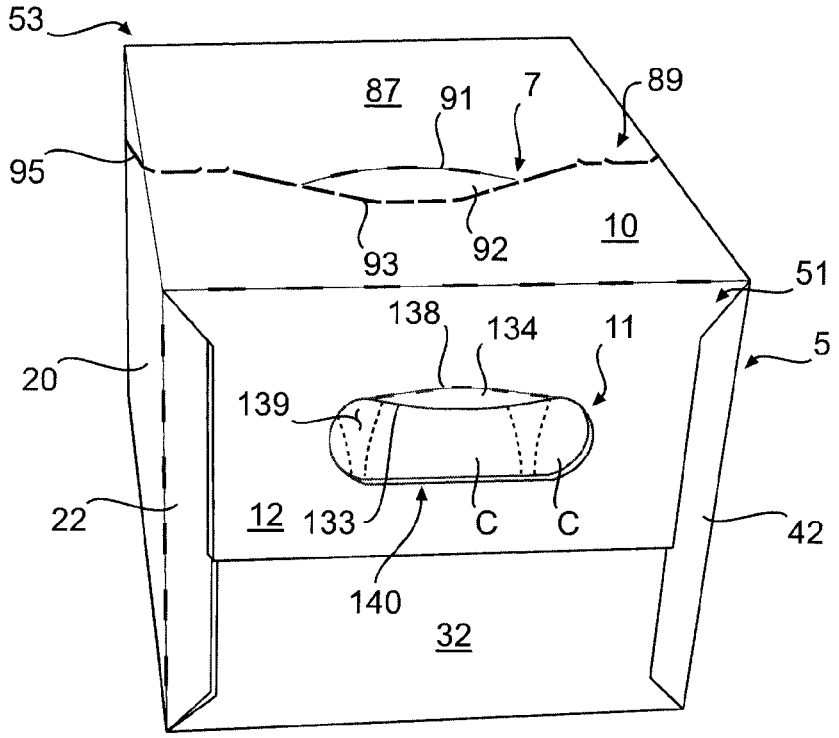
FIG. 7 is a perspective of the carton showing a handle opening in the first end of the carton.

As shown in FIG. 1, the features that form handle 11 of the carton 5 includes an elongate handle flap 131 formed in the top panel end flap 12 and foldably attached to the top panel at fold line 133. In the illustrated embodiment, the features of handle 11 includes an elongate comfort panel 134 adjacent the handle flap 131 and foldably attached to the top panel end flap 12 at a fold line 138. The fold line 138 connects respective ends of a tear line 140 that forms the handle flap 131 in the top panel end flap 12. In the illustrated embodiment, the handle flap 131 includes a curved fold line 142 extending between the curved ends of the flap to facilitate activation of the handle 11. The features of the handle 11 include respective curved cutouts 135, 137 in the end flaps 22, 42 to allow the elongate handle flap 131 to fold inwardly when the handle is activated to form a handle opening 139 (FIG. 7) in the carton. In the illustrated embodiment, the curved cutouts 135, 137 are in a respective main panel 46, 48 of the side panel end flaps 22, 42. The extension panels 61, 63 are discontiguous with the features (e.g., cutouts 135, 137) in a respective main panel 46, 48 that form handle 11. The elongate handle flap 131 is shaped and positioned in the blank 3 so that the handle 11 is activated by pressing on the handle flap and folding the handle flap inward into the curved cutouts 135, 137 to form the handle opening in the carton 5. The opening is shaped for insertion of a users fingers during grasping of the carton 5. The comfort panel 134 is shaped to fit a user's hand to facilitate grasping of the carton when the user's fingers are inserted into the handle opening 139 (FIG. 7). In the illustrated embodiment, when the carton 5 is closed and the handle 11 activated for grasping of the carton (FIG. 7), the handle flap 131 is folded inward along fold line 133 to be in opposing face-to-face relation with the interior surface of a respective upper portion of the side panel end flaps 22, 42. The handle 11 may be otherwise shaped and located in the carton 5 without departing from the scope of this invention.

In accordance with the exemplary embodiment, the blank 3 can be erected into the carton 5 by folding along fold lines 21, 31, 41, and 52 and adhering the adhesive flap 50 to the second side panel 40 to form a sleeve 141 (FIG. 2). The blank 3 may be otherwise configured to have multiple top panels and/or multiple bottom panels without departing from the scope of this invention. Further, the carton 5 may be a wrap-around type carton, with the blank 3 including locking features that can include primary and secondary locking features as is known in the art. These locking features may also comprise a single locking system or a double locking system such as those disclosed in U.S. patent application Ser. Nos. 10/183,935 and 10/703,704, the entire disclosures of which are incorporated by reference herein.

In the illustrated embodiment, the first end 51 of the carton 5 is closed by respectively overlapping and adhering the side end flaps 22, 42 and the top and bottom end flaps 32, 42 after the containers C are inserted into the carton. The second end 53 of the carton 5 is closed by respectively overlapping and adhering the side end flaps 24, 44 and top and bottom end flaps 14, 34. Once the blank 3 is formed into the sleeve 141, the containers C may be loaded in the carton 5 from the first end 51 and then the first end may be closed by overlapping and gluing the side end flaps 22, 42 and top and bottom end flaps 32, 42, and then the second end may be closed by overlapping and gluing the side end flaps 24, 44 and top and bottom end flaps 14, 34. Alternative loading and closing steps may be used without departing from the scope of this invention.

Figure 5:
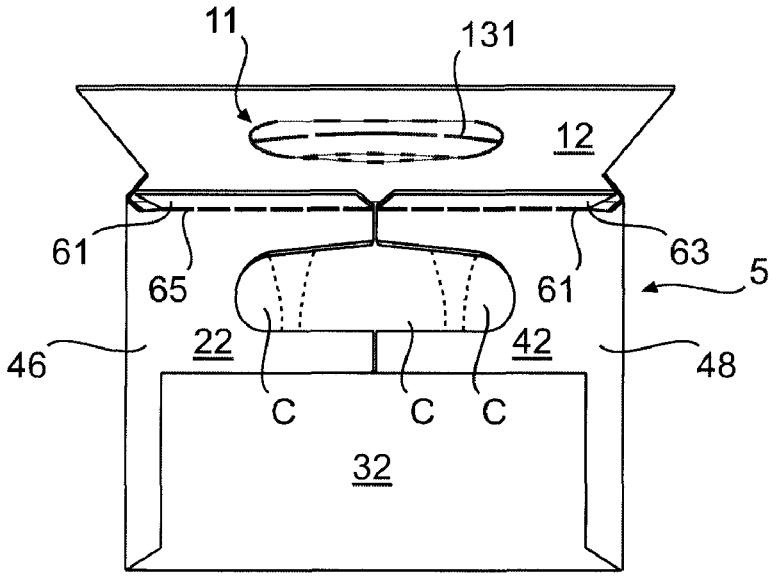
FIG. 5 is a view similar to FIG. 4 but showing the first end of the carton further closed.
Figure 6:
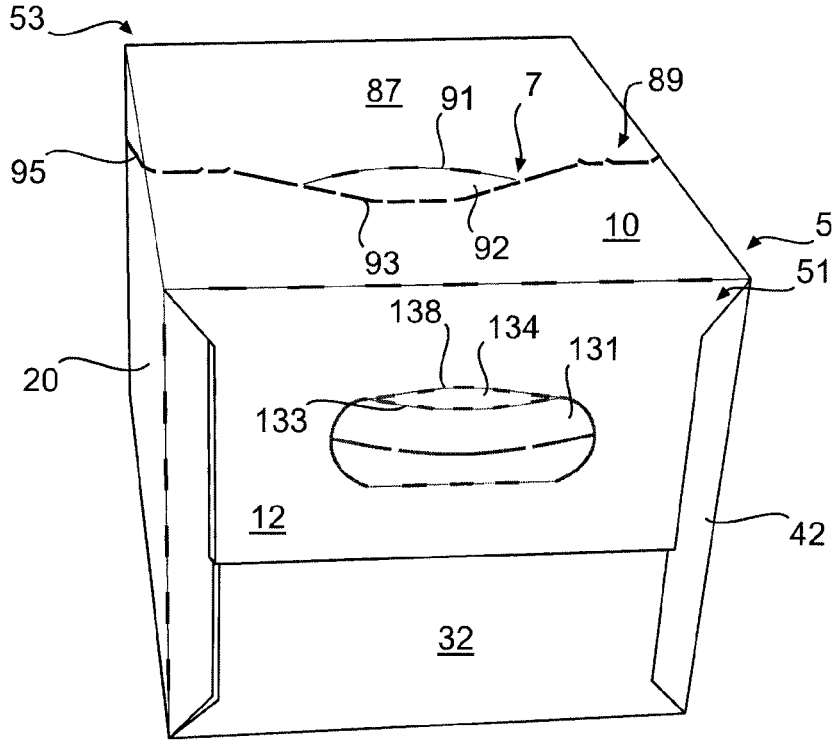
FIG. 6 is a perspective of the carton fully closed.

FIGS. 3-6 illustrate the closing of the first end 51 of the carton 5 according to one exemplary method. From the partially assembled position of FIG. 2, the top end flap 12 is raised to allow the side end flaps 22, 42 to be folded inwardly to partially close the end 51 of the carton 5. Alternatively, the step illustrated by FIG. 2 can be omitted. The bottom end flap 32 is raised (FIG. 4) and the top end flap 12 is lowered (FIG. 5) to further close the end 51 of the carton 5. When lowered from the position of FIG. 4, the top end flap 12 contacts the extension panels 61, 63 of the side end flaps 22, 42 to fold the extension panels downward along respective lateral fold lines 65, 67 so that the extension panels overlap an upper portion of each of the main panels 46, 48 between the extension panel fold lines and the cutouts 135, 137 (FIG. 5). The top panel 12 is then further folded downward and secured in the position shown in FIG. 6 so that the handle flap 131 is aligned with the handle cutouts 135, 137. The downwardly folded extension panels 61, 63 will typically be in opposing face-to-face contact with a respective upper portion of the main panels 46, 48 and a respective upper portion of the top end flap 12 that overlaps the side end flaps 22, 42 at the closed end 51 of the carton 5. The downwardly folded extension panels 61, 63 may be secured to the main panels 46, 48 of the side end flaps 22, 42 by adhesive such as glue. Also, the extension panels 61, 63 may be respectively secured to one or both of the top end flap 12 and a respective side end flap 22, 42.

The handle 11 may be used to grasp the carton 5 by pressing against the elongate handle flap 131 to create the handle opening 139 (FIG. 7) in the closed end 51 of the carton 5. The downwardly folded extension panels 61, 63 of the side end flaps 22, 42 provides an extra layer of material above the handle 11 to reinforce the carton 5 when the carton is lifted at the handle. It is understood that the carton 5 may have a second handle similar to or different from the handle 11 for grasping at the second end 53 of the carton. The handle 11 is shaped and positioned in the carton so that multiple fingers of a user may be placed through the handle opening 139 in the overlapped top end panel 12 and side end panels 22, 42 and the thumb of a user may be placed on the top panel 10 for grasping and lifting the carton 5. The extension panels 61, 63 increases the strength and rigidity of the carton 5 in the area above the handle 11 to prevent the carton from tearing or otherwise failing when lifted.

The blank 3 according to the present invention can be, for example, formed from coated paperboard and similar materials. For example, the interior and/or exterior sides of the blank 3 can be coated with a clay coating. The clay coating may then be printed over with product, advertising, price coding, and other information or images. The blank 3 may then be coated with a varnish to protect any information printed on the blank. The blank 3 may also be coated with, for example, a moisture barrier layer, on either or both sides of the blank. In accordance with the above-described embodiments, the blank 3 may be constructed of paperboard of a caliper such that it is heavier and more rigid than ordinary paper. The blank 3 can also be constructed of other materials, such as cardboard, hard paper, or any other material having properties suitable for enabling the carton 5 to function at least generally as described herein. The blank 3 can also be laminated or coated with one or more sheet-like materials at selected panels or panel sections.

In accordance with the above-described embodiments of the present invention, a fold line can be any substantially linear, although not necessarily straight, form of weakening that facilitates folding therealong. More specifically, but not for the purpose of narrowing the scope of the present invention, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present invention for each of the tear lines to be replaced with a continuous slit, or the like. For example, a cut line can be a continuous slit or could be wider than a slit without departing from the present invention.

The above embodiments may be described as having one or more panels adhered together by glue during erection of the carton embodiments. The term "glue" is intended to encompass all manner of adhesives commonly used to secure carton panels in place.

The foregoing description of the invention illustrates and describes the present invention. Additionally, the disclosure shows and describes only selected embodiments of the invention, but it is to be understood that the invention is capable of use in various other combinations, modifications, and environments and is capable of changes or modifications within the scope of the inventive concept as expressed herein, commensurate with the above teachings, and/or within the skill or knowledge of the relevant art.

What is claimed is:

1. A method of assembling a carton comprising:

obtaining a carton comprising a plurality of panels comprising a top panel, a bottom panel, a first side panel, and a second side panel, at least two side end flaps each foldably attached to at least one of the side end panels at a first end of the carton, at least one top end flap foldably attached to the top panel at the first end, and a handle formed at least in part in the top end flap and at least one of the at least two side end flaps, each of the at least two side end flaps comprising a main panel for at least partially closing the first end of the carton and an extension panel foldably attached to the main panel above the handle of the carton;

folding the at least two side end flaps to at least partially close the first end of the carton;

folding the top end flap downward to contact the extension panel of each of the at least two side end flaps and to fold the extension panels downward to overlap the respective main panel of each of the at least two side end flaps during the at least partially closing of the first end; and securing the top panel in the downwardly folded position to at least partially close the first end of the carton.

2. The method of claim 1 further comprising securing the extension panel to the main panel for each of the at least two side end flaps.

3. The method of claim 1 wherein the handle comprises a handle flap foldably attached to the top end flap and handle cutouts in the at least two side end flaps, and the method further comprises folding the handle flap into the handle cutouts in the at least two side end flaps to form a handle opening of the carton.

4. The method of claim 1 wherein the carton further comprises a plurality of end flaps at the second end of the carton and the method further comprises overlapping the plurality of end flaps at the second end to close the second end of the carton.

5. The method of claim 1 wherein folding the top end flap and the extension panel of each of the at least two side end flaps downward places the extension panels in face-to-face contact with an exterior surface of the respective main panel and an interior surface of the top end flap.

6. The method of claim 5 wherein the handle comprises handle cutouts in the at least two side end flaps, and wherein for each of the at least two side end flaps the extension panel extends from a lowermost point at a respective one of the cutouts to a fold line connecting the extension panel to the respective main panel.

7. The method of claim 1, wherein the carton further comprises a bottom end flap foldably connected to the bottom panel, the method further comprising folding the bottom panel upward into face-to-face contact with the main panel of each of the at least two side end flaps.

8. A carton formed by the method of claim 1.

9. The carton of claim 8, wherein the at least one top end flap at least partially overlaps the main panel of each of the at least two side end flaps.

10. The carton of claim 8 wherein the at least two side end flaps comprise a first side end flap foldably attached to the first side panel and a second side end flap foldably attached to the second side panel.

11. The carton of claim 10 wherein the handle comprises a handle cutout in each of the first side end flap and the second side end flap.

12. The carton of claim 11 wherein the handle comprises a handle flap foldably attached to the top end flap for forming a handle opening aligned with the handle cutouts.

13. The carton of claim 11 wherein the extension panel of the first side end flap extends from a lowermost point at the cutout of the first side end flap to a fold line connecting the extension panel to the main panel.

14. The carton of claim 11 wherein the extension panel of the first side end flap is in face-to-face contact with an exterior surface of the main panel above the cutout of the first side end flap.

15. The carton of claim 8 wherein for each of the at least two side end flaps the extension panel is secured to the main panel.

16. The carton of claim 8, further comprising a bottom end flap foldably connected to the bottom panel and in face-to-face contact with the exterior surface of the main panel of each of the at least two side end flaps.

17. The carton of claim 8 in combination with a plurality of articles, the plurality of articles comprising bottles that are arranged in an upright position in the carton.

18. A method of assembling a carton comprising:

obtaining a carton comprising a plurality of panels, comprising a top panel, a bottom panel, a first side panel, and a second side panel, at least two side end flaps each foldably attached to at least one of the side end panels at a first end of the carton, at least one top end flap foldably attached to the top panel at the first end, each of the at least two side end flaps comprising a main panel for at least partially forming a closed end of the carton and an extension panel foldably attached to the main panel;

folding the at least two side end flaps;

folding the top end flap downward to contact the extension panel of each of the at least two side end flaps and to fold the extension panel downward to overlap the main panel for each of the at least two side end flaps; and securing the top panel to at least partially close the carton.

19. A carton formed by the method of claim 18, wherein the at least one top end flap at least partially overlaps the main panel of each of the at least two side end flaps.

20. The carton of claim 19 wherein the at least two side end flaps comprise a first side end flap foldably attached to the first side panel and a second side end flap foldably attached to the second side panel.

21. The carton of claim 20 wherein each of the first side end flap and the second side end flap comprises a handle cutout.

22. The carton of claim 21 wherein the extension panel of the first side end flap is in face-to-face contact with an exterior surface of the main panel above the cutout of the first side end flap.

23. The carton of claim 22 wherein the extension panel of the first side end flap extends from a lowermost point at the cutout of the first side end flap to a fold line connecting the extension panel to the main panel.

24. The carton of claim 23 further comprising a handle flap foldably attached to the top end flap for forming a handle opening aligned with the handle cutouts.

* * * * *